US012735229B2

(12) United States Patent
Selinger

(10) Patent No.: US 12,735,229 B2
(45) Date of Patent: Sep. 15, 2026

(54) PACKAGING FOR A PRODUCT, IN PARTICULAR FOR A FOOD PRODUCT

(71) Applicant: Syntegon Technology GmbH, Waiblingen (DE)

(72) Inventor: Gebhard Selinger, Lorch (DE)

(73) Assignee: Syntegon Technology GmbH, Waiblingen (DE)

( * ) Notice: Subject to any disclaimer, the term of this patent is extended or adjusted under 35 U.S.C. 154(b) by 42 days.

(21) Appl. No.: 18/864,229

(22) PCT Filed: May 10, 2023

(86) PCT No.: PCT/EP2023/062486

§ 371 (c)(1),
(2) Date: Nov. 8, 2024

(87) PCT Pub. No.: WO2023/217895

PCT Pub. Date: Nov. 16, 2023

(65) Prior Publication Data

US 2025/0326530 A1 Oct. 23, 2025

(30) Foreign Application Priority Data

May 11, 2022 (DE) ..... 10 2022 111 829.0

(51) Int. Cl.
*B65D 33/00* (2006.01)
*B65D 75/52* (2006.01)

(52) U.S. Cl.
CPC ..... *B65D 33/007* (2013.01); *B65D 75/525* (2013.01)

(58) Field of Classification Search
CPC ..... B65D 75/52; B65D 75/525; B65D 75/58; B65D 75/5805
(Continued)

(56) References Cited

U.S. PATENT DOCUMENTS 3,272,423 A 9/1966 Maro
3,339,721 A 9/1967 Goldstein
(Continued)

FOREIGN PATENT DOCUMENTS

DE 29513301 U1 10/1995
EP 3609804 A1 2/2020
(Continued)

OTHER PUBLICATIONS

International Search Report and Written Opinion for Application No. PCT/EP2023/062486 dated Sep. 12, 2023 (14 pages).
(Continued)

*Primary Examiner* — Bryon P Gehman
(74) *Attorney, Agent, or Firm* — Michael Best & Friedrich LLP

(57) ABSTRACT

Packaging (1) for a product (25), having a bag (2) for accommodating the product (25) and having a cardboard sleeve (3), which is arranged around the outside of the bag (2), wherein the bag (2) is of flattened form with two flattened bag areas (4) located opposite one another, and wherein the cardboard sleeve (3) has a cardboard base area (5), which forms a standing area (6) of the packaging (1), and also two cardboard areas (7) which adjoin the cardboard base area (5), opposite one another, extend upwards from the cardboard base area, are connected to the cardboard base area (5) by first lines of inflection (8) and cover the flattened bag areas (4), wherein exposed regions (9) of the bag (2) are arranged between the upwardly extending cardboard areas (7).

15 Claims, 7 Drawing Sheets

(58) Field of Classification Search
USPC ..... 206/554
See application file for complete search history.

(56) References Cited

U.S. PATENT DOCUMENTS

| | | | | | |
|---|---|---|---|---|---|
| 3,640,381 | A * | 2/1972 | Kanada | B65D 75/5816 229/206 |
| 3,684,156 | A | 8/1972 | Fettinger et al. | |
| D271,943 | S * | 12/1983 | Beise | D9/415 |

FOREIGN PATENT DOCUMENTS

| | | | | |
|---|---|---|---|---|
| FR | 2587978 | A1 | 4/1987 | |
| GB | 2372491 | A | 8/2002 | |
| JP | 2006248576 | A | 9/2006 | |
| KR | 20140004777 | U | 8/2014 | |
| KR | 2020140004777 | U | 8/2014 | |
| WO | 2018189006 | A1 | 10/2018 | |
| WO | WO-2018189004 | A1 * | 10/2018 | B65D 75/525 |

OTHER PUBLICATIONS

German Patent Office Action for Application No. 102022111829.0 dated Mar. 31, 2023 (18 pages including English translation).
European Patent Office Examination Report for Application No. 23726069.0 dated Jan. 13, 2026 (12 pages including English machine translation).

* cited by examiner

PACKAGING FOR A PRODUCT, IN PARTICULAR FOR A FOOD PRODUCT

BACKGROUND

The invention relates to a packaging for a product, wherein the packaging is suitable in particular for packaging free-flowing food products.

Particularly free-flowing products are often packaged in bags. These bags have different configurations and shapes. The most important types are in this instance "pillow bags", "gusseted bags", "block-bottom bags", "4-corner seal bags", "doy bags" etc. The presentation of the products/bags is in this instance either vertical or horizontal in the sales areas. However, the vertical presentation is from the point of view of trade often more attractive and preferable since the product information and the marketing can be arranged directly in the field of vision of the consumer on a surface of the bag. Furthermore, bags can often also be arranged vertically in a more orderly manner in the outer packaging or transport packaging.

In order to enable a vertical presentation of a bag, a stability of the bag is required so that it cannot fall over. The production of such stable bags is, however, generally slightly more complex since special configurations are required in order to produce a standing face and where applicable stronger (more expensive) materials have to be used. This is also reflected in slower cycle times on a packaging machine.

Another form of known packagings which have these disadvantages or advantages are bags which are packaged in an (additional) outer box (bag-in-box packaging). For example, cereals are often provided to consumers in bags and folding cartons. This naturally results in a higher use of material. As a result of the additional outer box, thinner film materials can be used where applicable. However, the overall material use (bag+outer box) is generally increased.

SUMMARY

An object of the present invention is to at least partially solve the problems set out with respect to the prior art. This object is achieved with the invention according to the features of the independently worded patent claims. Other advantageous embodiments are set out in the dependent patent claims and in the description and in particular also in the description of the figures. It should be noted that the person skilled in the art combines the individual features in a technically advantageous manner and consequently arrives at other embodiments of the invention.

A packaging is described for a product having a bag for receiving the product and a cardboard sleeve which is arranged externally around the bag, wherein the bag has a flattened shape with two mutually opposing flattened bag faces and wherein the cardboard sleeve has a box base face which forms a standing face of the packaging, and has two box faces which adjoin the box base face in a mutually opposing manner and extend upward from the box base face and which are connected by means of first folding lines to the box base face and cover the flattened bag faces, wherein between the upwardly extending box faces exposed regions of the bag are arranged.

The invention enables the vertical presentation of a pillow bag using a carton sleeve which significantly reduces the material use of an outer box (bag-in-box) by up to 40%. Advantages with regard to existing solutions include rapid product speeds of pillow bags compared with the slower production speed of stable bags, product protection as a result of a carton sleeve with significantly less material consumption compared with a bag-in-box solution, reduction of the costs as a result of higher speeds and lower material costs.

The bag is preferably produced from a plastics material and flexible. Preferably, the bag itself has no or only a low level of mechanical stability and would not be stable. Preferably, the bag itself also has no standing face. Preferably, the bag is produced from a tubular starting material which at ends is closed in each case with a linearly extending closure seam on which the tubular starting material is pressed flat and welded to itself.

The term "sleeve" refers to an enclosure made of cardboard which is arranged around the bag and which forms the standing face described. The sleeve ensures an orientation of the bag in a vertical position on the standing face.

The term "cardboard" refers to a planar material which substantially comprises fibers (in particular plant-based fibers) and which is preferably formed by means of drainage of a fiber suspension. A "cardboard" has compared with a paper in particular an increased mechanical strength. Preferably, the "cardboard" has a minimum weight per square meter of cardboard surface-area of 130 g/m$^2$ [gram/square meter].

Exposed regions are in this instance intended to be understood to be regions which, when the packaging is not open (in particular in the provided state as the packaging is presented in sales areas), are not covered by cardboard material of the cardboard sleeve. The bag can be seen from the outer side at the exposed regions. The exposed regions may, for example, also be understood to be cut-outs of the cardboard sleeve.

A folding line of the box or the cardboard sleeve is a region in which a face of the box is folded over so that two box part-faces which can be moved relative to each other at the folding line about the folding line are formed.

The bag has a flattened shape with flattened bag faces. As already set out above, the bag is preferably produced from a tubular starting material. Preferably, this starting material is slightly flattened and at the ends of the bag (at which the tubular starting material is, for example, connected to itself with a closure seam) is even completely pressed flat in order to form the flattened shape with flattened bag faces. The flattened bag faces face each other. Between the flattened bag faces there are in each case regions of the bag which can be referred to as narrow sides. The narrow sides at the same time preferably form the exposed regions of the bag. The flattened bag faces are preferably covered by the cardboard sleeve and in particular by the upwardly extending cardboard faces of the cardboard sleeve.

The box base face or the standing face and the extent direction of the box faces in an upward direction preferably refers to a geodetic orientation of the packaging in an arrangement for presentation in a sales area. When the bag is arranged as provided in a sales area, it stands on the standing face or the box base face and the box faces which extend from the box base face stand upward.

The packaging having the sleeve and the bag is from the point of view of the user preferably a component in which the sleeve and the bag are securely connected to each other. This applies particularly while the packaging is used for the intended use. The sleeve and the bag are connected to each other during the production of the packaging and preferably cannot be released from each other without being destroyed. Where applicable, however, a separation of the sleeve and bag for separate recycling of the sleeve and bag is possible.

At least a separation and a subsequent rejoining of the sleeve and bag during correct use of the packaging are not provided. The sleeve serves to permanently stabilize the bag when it is used. From the point of view of the user, the sleeve and the bag together form the packaging.

The present packaging enables in an efficient manner using a cardboard sleeve additional protection and stability for a product which is provided in a bag to be provided. The cardboard sleeve is in particular formed from a cardboard blank which substantially corresponds to the width of the bag and which is folded over (in each case at the side of a portion which forms the box base face) at folding lines so that box faces which form the two lateral portions which substantially corresponds to the height of the bag are formed. A depth of the box base face preferably corresponds to the depth of the bag (perpendicularly to the flattened bag faces).

The product which can be received in the packaging or the bag is in particular a product which itself has no permanent mechanical stability. In order to be able to present such products in a vertical packaging, it is necessary to ensure with the packaging adequate stability or durability.

The product is in particular a free-flowing product. The product may also be completely or partially viscous. The product is, for example, a liquid or a paste. Another type of product which can be received in the packaging or the bag are products which temporarily but not permanently have a mechanical stability, for example, compactable powdered products, the powdered particles of which temporarily (in particular after compacting) adhere to each other. Such products are, where applicable, not free-flowing. The product may, for example, be one of the following products: flour, coffee, tea, sugar, salt, cereal, muesli. This listing is not definitive.

Where applicable, a product for which in principle no packaging with mechanical stability would be required can also be packaged in the packaging described here. This may, for example, be the case since the packaging described here is advantageous for the respective product for other reasons, for example, for reasons of marketing or since the packaging was selected in order to enable particularly comfortable handling of the product for the user. In variants, it may be the case that the filling quantity of the product in the packaging is adjusted in such a manner that the product in the packaging itself cannot exhibit any inherent mechanical stability, but the product with a different filling quantity would be in a position to exhibit an inherent stability. This may, for example, apply for products such as flour. Flour can be packaged in a conventional flour paper bag and in such a packaging can also be packed so densely that, as a result of the inherently flexible packaging in combination with the dense packing of the product, a mechanical rigidity of the assembly comprising the packaging and the product is achieved. If the flour is packed in the packaging described here, it is advantageous not to fill the packaging so significantly or not completely. This can considerably simplify the handling for the user/consumer when the packaging is open since where applicable the open packaging then also has adequate stability and where applicable the removal of the product from the packaging is simplified.

In addition to the advantage that for the packaging described here on the whole relatively little box material and little bag material are required since the box material or the cardboard sleeve does not completely surround the bag but at the same time the bag can be produced from a thin material, other advantages further exist. Another advantage is that the box material of the box sleeve and the bag material of the bag can be mechanically separated from each other very easily. This improves the possible ways of recycling the bag material and the box material separately from each other.

Preferably, the bag comprises a flexible bag material which preferably has at least one barrier layer.

The flexible bag material may in particular comprise/be a film material which is formed, for example, with plastics material and where applicable was produced by means of extrusion blow molding or other suitable production methods.

The flexible bag material may in variants also be a flexible paper.

As a result of the packaging described, the material of the bag may in particular be processed without layer jumps (portions of bag material located one above the other). When the bag material is provided as a tubular starting material, only two closure seams are required to close the bag when the product is poured into the bag. In particular, materials which are not suitable for more complex bag shapes (which themselves ensure a stability) can also be used for the bag—for example, bags made of sustainable materials (fiber materials, mono-materials, etcetera). This also enables a tight sealing, whereby particularly sensitive goods can be well protected.

The at least one barrier layer serves in particular to protect the product in the packaging. In this instance, the at least one barrier layer can serve to prevent specific substances from the environment from reaching the bag of the packaging and damaging the product. These include in particular air and moisture. In this instance, at least one barrier layer may also serve to prevent product components from being discharged through the bag of the packaging. Such product components include, for example, aromas and flavorings. Such barrier layers are, for example, very important when the product is coffee.

Depending on the type of product, suitable barrier layers may be provided. Vapor barrier layers may be used as a barrier layer and serve to protect from penetrating moisture. Barrier layers which serve to prevent the discharge of aromas may be provided. Such barrier layers preferably have a low permeability for molecules of any type. Barrier layers which prevent the passage of oxygen may be used.

In variants of the packaging for specific products and product groups, barrier layers can also be completely dispensed with. For example, for products such as flour or sugar generally no (separate) barrier layer is required, but instead a paper may be sufficient as the bag material.

The barrier layer may be an independent layer which is connected to an additional layer (in particular a carrier layer) of the bag. The barrier layer may where applicable also be applied to a carrier layer of the bag, for example, printed, vapor-deposited or painted on.

It is particularly advantageous for the bag to comprise a transparent material so that a product contained in the bag is visible at the exposed regions of the bag.

For advertising purposes, it is often very advantageous for the presentation of a product in a sales area for the product itself to be visible in the bag. Completely transparent packagings are often disadvantageous since no explanations or promotional illustrations are possible on completely transparent packagings. Viewing windows in packagings are generally complex to produce since transparent materials for forming viewing windows and non-transparent materials for providing surfaces for promotional illustrations have to be connected to each other.

As a result of the described packaging, on the one hand, transparent regions at which the product contained in the bag can be seen can be produced. On the other hand, promotional surfaces can be provided on the cardboard sleeve.

It is further advantageous for the bag to be secured to the box base face of the cardboard sleeve.

The securing is preferably carried out in the manner of a permanent connection between the bag and cardboard sleeve which is preferably not releasable without the bag and/or the sleeve being damaged and the separation thereof during the use of the packaging for the correct purpose for storing the product is also not provided.

In preferred variants, the bag is adhesively bonded to the base face. It is also conceivable for the bag to be fitted with a provided apparatus (for example, a flap or the like) to the base face of the cardboard sleeve and a plug type connection thus to be formed. A welding of the bag to the base face is in principle also possible.

In a particularly advantageous manner, a fastening of the bag to the box base face is configured in a releasable manner, for example, using an adhesive which can be separated at a specific release force. In this manner, a separation of the cardboard sleeve and bag for recycling may be enabled. Hot adhesives are in particular used as an adhesive for adhesive connections between the bag and box faces of the cardboard sleeve.

It is advantageous for the upwardly extending box faces to be connected to each other at a position of the packaging with spacing from the standing face at each of the two sides by means of at least one box connection web, wherein the box connection webs are connected by second folding lines to one of the upwardly extending box faces and to the other upwardly extending box face in each case. The connection is in particular configured with an adhesive connection or a plug type connection.

Preferably, the position spaced apart from the standing face is arranged starting from the standing face opposite at an upper side of the packaging. The connection webs preferably form together with upper edge faces of the upwardly extending box faces a frame which surrounds an opening of the packaging when the packaging is open.

It is further advantageous for the box connection webs to be subdivided in each case into at least two box web segments which are separated from each other by means of third folding lines so that, as a result of a deformation of the box connection webs at the third folding lines, a change of the spacing of the upwardly extending box faces at an upper side of the packaging is enabled so that an access region into the packaging can be expanded.

Prior to a user opening the packaging in the shape in which the packaging was produced, the connection webs are always "folded together". Preferably, the two box faces taper from the box base face or the standing face in this state toward each other and the packaging has in the upper region thereof a linear closure.

When the packaging is opened, the box connection webs can be folded open and the box faces which taper toward each other can be moved apart so that there is a spacing between the box faces which is limited by the length of the box connection webs. An opening of the packaging is defined by the spacing of the box faces and the width of the box faces at the upper end of the packaging.

It is further advantageous in an access region at an upper side of the packaging for the bag to have an opening line at which the bag can be separated in order to open the bag.

On the opening line, the bag and the box faces may preferably be separated together. An (upper) closure seam of the bag is preferably located above the opening line and can be separated from other portions of the packaging when the bag and the box faces are separated at the opening line. When the (upper) closure seam is separated, the two flattened bag faces and the box faces are no longer connected to each other by means of this (upper) closure seam and can be moved apart in order to open the bag or the packaging.

It is further advantageous for the flattened bag face to be connected at least in an upper region opposite the standing face to the upwardly extending box faces by means of at least one linear connection. The linear connection is in particular a linear adhesive bond. Alternatively, for example, this may also be a welding.

Preferably, between two flattened bag faces and the box faces which cover the flat bag faces, there is in each case at least one adhesive bond. The two covering box faces are consequently preferably connected to the bag via the two adhesive bonds and then also indirectly by means of a closure seam of the bag. The two adhesive bonds and the closure seam of the bag together ensure that the two box faces at the upper region of the packaging in the closed state of the packaging cannot be moved apart (or only to a small degree).

As a result of such an adhesive bond, it may preferably be possible for the bag to be retained at the box faces and to be located within the cardboard sleeve. Preferably, an adhesive bond fixes the bag to the box faces of the cardboard sleeve both when the packaging is closed and when the packaging or the bag is open.

It is further advantageous for at least one of the upwardly extending box faces to be connected with two linear connections which are arranged one above the other to the flattened bag face, wherein an opening line is arranged between the two linear connections. The two linear connections are in particular linear adhesive bonds. Alternatively, for example, this may also be a welding.

Preferably, there are between two flattened bag faces and the box faces which cover the flat bag faces two linear connections in each case.

Preferably, a closure seam of the bag is located above the opening line and in a particularly preferred manner at the height of the upper of the two linear connections. When the packaging is opened or separated at the opening line, the closure seam together with the upper linear connections is then preferably removed. There are then only the lower linear adhesive bonds of the box faces to the bag and the box faces can be moved apart.

It is further advantageous for the bag to have a first width and wherein at least one of the upwardly extending box faces has a second width which is reduced compared with the first width at least in regions.

Preferably, the standing face or the box base face has the same width as the bag, that is to say, in particular the first width. Where applicable, the standing face is even slightly wider.

The reduced width is preferably configured in the region of the upwardly extending box faces so that, from a viewing direction toward one of these box faces, lateral regions of the bag are visible.

In variants, the reduced second width may also be produced in regions of the box base face so that the cardboard sleeve is also narrower than the bag in this instance. The cardboard sleeve thus does not have to cover the entire bag width, but instead it may be sufficient for the cardboard sleeve to cover only a portion of the bag width.

A method for producing a packaging is described here, having the following steps:

a) providing a bag with a flattened shape with two mutually opposing flattened bag faces, containing a product;

b) supplying a cardboard blank having a box base face and two box faces which are connected to the box base face by means of first folding lines;

c) folding the cardboard blank along the folding lines around the bag so that a cardboard sleeve is produced around the bag.

The cardboard sleeve of the packaging described is produced from the cardboard blank. Preferably, during the production (in particular before or after step c)), the cardboard blank or the cardboard sleeve which is formed from the cardboard blank and the bag are connected to each other or secured to each other. Preferably, at least one permanent connection (which in particular cannot be released without being destroyed) is formed between the bag and the cardboard blank or the cardboard sleeve.

It should be noted that the specific advantages and embodiment features set out in connection with the above-described packaging can also be used and transferred for the method described below.

The method is particularly advantageous when the flattened shape of the bag is orientated horizontally during steps b) and c).

In a particularly preferred manner, vibrations of the bag can then be used in order to distribute the product in a uniform manner. As soon as the cardboard sleeve is placed around the bag, the sleeve then prevents an undesirable deformation of the bag and an undesirable change of the distribution of the product in the bag.

In other variants of the method, it is advantageous for the flattened shape of the bag to be orientated in a perpendicular manner during steps b) and c).

It is further advantageous for a supply of the cardboard blank to the bag to be carried out from below. A relative movement of the cardboard blank to the bag is hereby described. The bag can be moved downward in order to move it closer to the cardboard blank and/or the cardboard blank can be moved in an upward direction.

The supply of the cardboard blank may, for example, be carried out directly below the bag machine in which the bags are filled with the product. Preferably, the bag is placed centrally on the cardboard blank.

One advantage of the vertical supply is that the filling of the bags with the product is normally also carried out with the aid of gravitational force in a vertical orientation of the bag. Generally, the bag hangs at an upper end when being filled with the product. The lower end of the bag is preferably already closed with a closure seam.

For the horizontal approach supply, the bag must first also be closed at the top with a closure seam, and can then be placed. However, this horizontal approach enables the product to be levelled in the bag so that a uniform product distribution takes place.

The method is particularly further advantageous when the folding of the cardboard blank in step c) is carried out by means of a folding box into which the cardboard blank is introduced, wherein, as a result of the introduction, a folding of the cardboard blank along the first folding lines is supported.

Another possibility of forming the cardboard blank to form the cardboard sleeve can also be carried out by means of a folding box which can also be referred to as a cartridge. In this instance, the cardboard blank is introduced in a first variant of the method into the folding box. In a second variant, the cardboard blank is placed on the folding box—in particular in such a manner that the box base face conceals an opening of the folding box. In the first variant, the bag is introduced into the folding box in which the box faces of the cardboard sleeve are already correctly positioned. In the second variant, the cardboard blank and the bag are inserted together into the folding box and in this instance the box faces of the cardboard sleeve are also orientated.

The advantage of carrying out the method with a folding box is generally that the cardboard blank and the bag have a stable surrounding housing during the joining process, which reduces the joining tolerances of the two objects-particularly when box faces of the cardboard sleeve and the bag are adhesively bonded to each other.

A particular advantage during the production of the described packaging in comparison with the production of a packaging with a bag and a complete surrounding box is that the cardboard sleeve can be placed around the bag. In contrast, when using a complete surrounding box, it is necessary to introduce the bag into the already fully folded surrounding box. The placing of the sleeve can be integrated in a process for producing a filled packaging in a much simpler manner.

BRIEF DESCRIPTION OF THE DRAWINGS

The invention and the technical field of the invention are explained in greater detail below with reference to the figures. The figures show preferred exemplary embodiments to which the invention is not limited. It should particularly be noted that the figures and in particular the size relationships illustrated in the figures are purely schematic. In the drawings.

DETAILED DESCRIPTION

Figure 1:
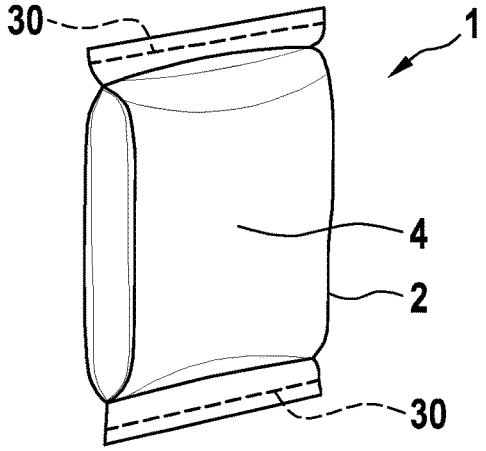
FIG. 1: shows a packaging.

FIG. 1 shows a packaging 1 which comprises a bag 2. The bag 2 is closed at both sides by means of a closure seam 30 which is, for example, adhesively bonded, welded and/or configured with a fold and it has two flattened bag faces 4 on which, for example, promotional illustrations and/or production descriptions can be displayed. This type of bag cannot be placed upright in such a manner that the flattened bag face 4 with promotional illustrations and/or product descriptions is visibly presented in a sales area. The packaging 1 illustrated in FIG. 1 is often also referred to as a "pillow bag".

Figure 2A:
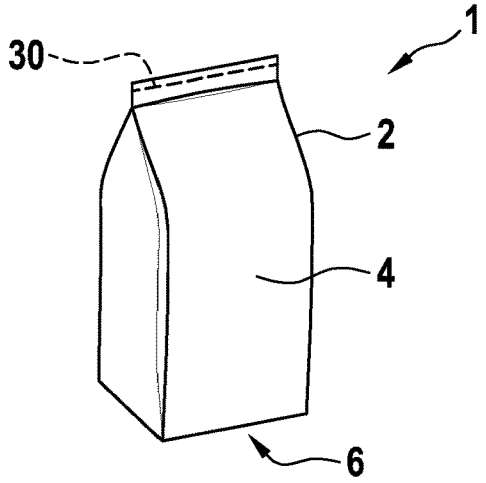
FIGS. 2*a* and 2*b*: show different packagings which are suitable for vertical presentation.
Figure 2B:
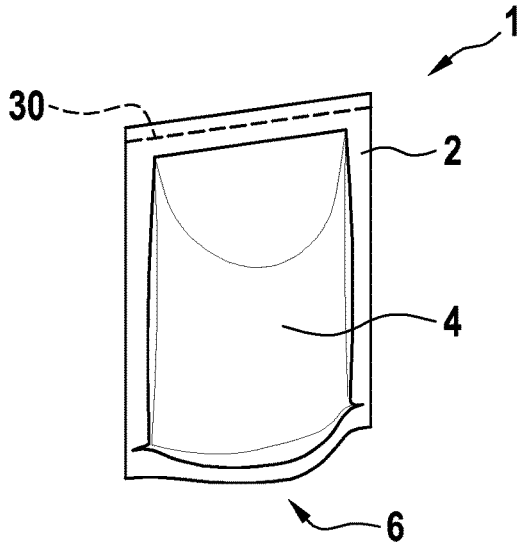

In order to enable a presentation of promotional illustrations and/or product descriptions on a flattened bag face, the packagings 1 according to FIGS. 2*a* and 2*b* are known. In these packagings 1, the bag 2 has only at an upper side 18 a closure seam 30 which is adhesively bonded, welded and/or configured with a fold. At a lower side, these bags 2 in each case have a standing face 6 which ensures that the bag can be placed upright in such a manner that the flattened bag face 4 is visibly presented with promotional illustrations and/or product descriptions in a sales area. In the variant according to FIG. 2*a*, the bag 2 has a square cross sectional shape and the standing face 6 is preferably formed by means of folded regions of the bag 2. In the variant according to FIG. 2*b*, the standing face 6 is preferably formed by a base face element which is adhesively bonded or welded in the bag 2. In principle, the variants of packagings 1 which are illustrated in FIGS. 2*a* and 2*b* on the basis of bags 2 are complex to produce. Additional working steps are required in order to produce the standing faces 6. Furthermore, in these variants, it is generally necessary to use for the bag 2 itself a slightly stronger material which provides adequate mechanical stability so that the bag 2 or the packaging 1 stands. The packagings 1 illustrated in FIG. 2*a* and FIG. 2*b* are often also referred to as block-bottom bags, 4-corner seal bags, doy bags, etcetera.

Figure 3C:
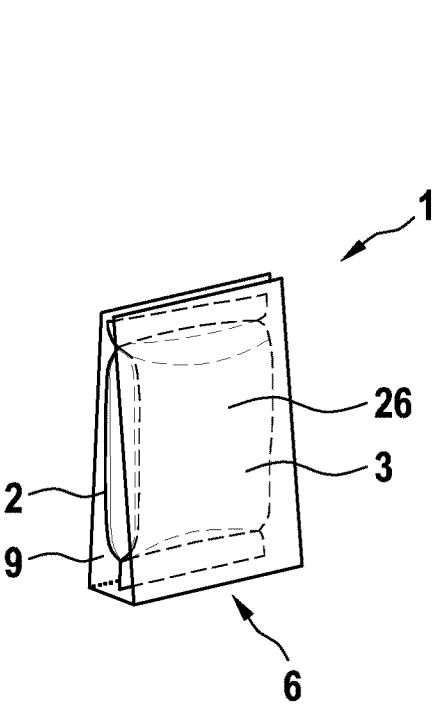
FIGS. 3*a* to 3*c*: show a sequence of a method for producing the described packaging with an illustration of the packaging described in various method states.
Figure 3B:
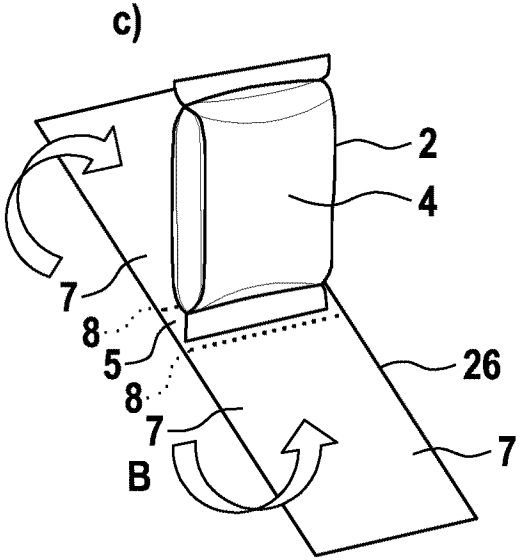
Figure 3A:
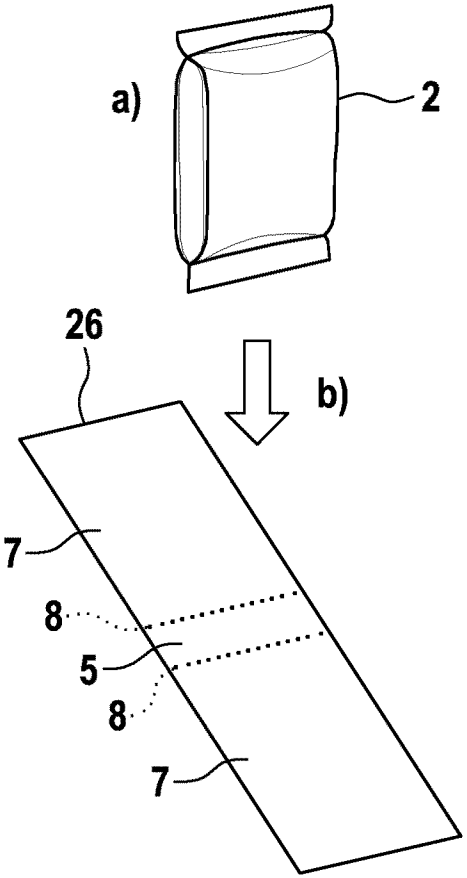

FIGS. 3*a* to 3*c* show a sequence of a method for producing the packaging 1 described in this instance with an illustration of the described packaging 1 in different method states. The packaging 1 described in this instance is based on a bag 2, as also illustrated in FIG. 1, and which would not per se be stable. In a step a), such a bag 2 is provided. In a step b), a cardboard blank 26 which has a box base face 5 and additional box faces 7 which are connected to the box base face 5 by means of first folding lines 8 is then supplied. The steps a) and b) are illustrated in FIG. 3*a*. In FIG. 3*b*, step c) is then illustrated. The cardboard blank 26 is then bent over at the first folding lines 8 so that the box faces 7 extend upward from the box base face 5 and cover the flattened bag faces 4 of the bag 2. FIG. 3*c* then shows the packaging 1 which is described here and which was produced by means of the method. The cardboard blank 26 forms the cardboard sleeve 3 which surrounds the bag 2 and forms the base face 2, wherein laterally exposed regions 9 of the bag 2 which are not concealed by the cardboard sleeve 3 exist.

Figure 4A:
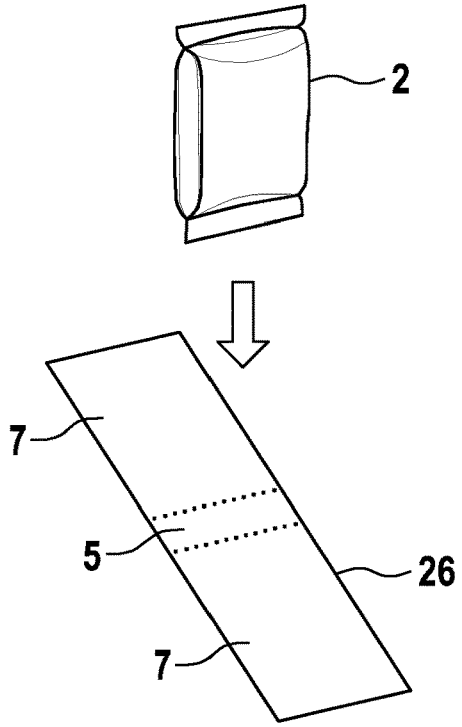
FIGS. 4*a* and 4*b*: show two different variants for supplying a bag to a packaging and to a cardboard sleeve.
Figure 4B:
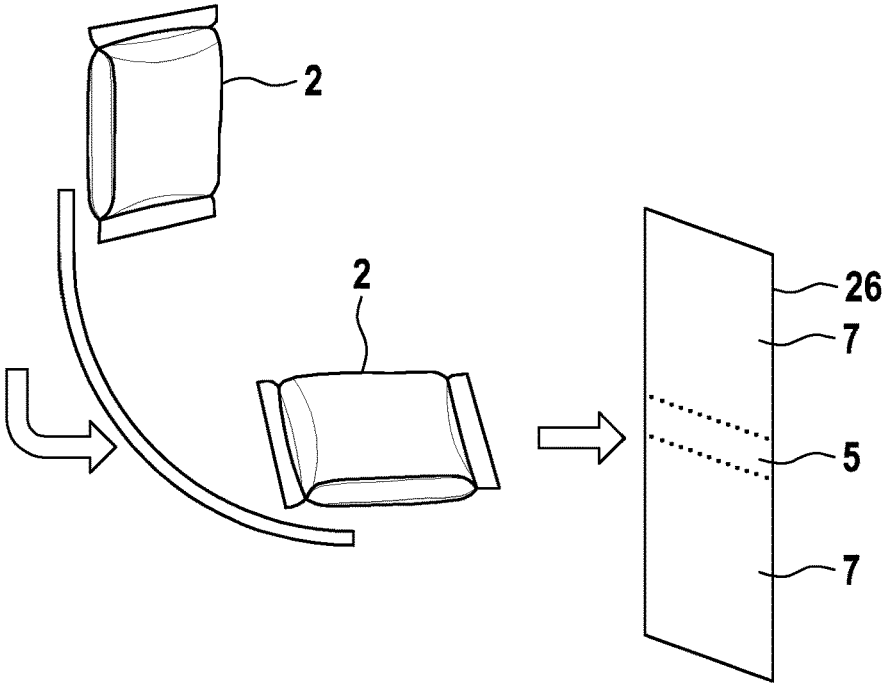

FIGS. 4*a* and 4*b* show two different variants of the supply of a bag 2 to a cardboard blank 26. As a result of the type of supply of the bag 2, in particular the distribution of the product 25 contained in the bag 2 can be controlled. FIG. 4*a* shows a vertical supply. In this instance, the bag 2 is arranged vertically and product 25 contained in the bag 2 has a tendency to accumulate at one end of the bag 2. Packagings which taper upward can thus be produced. FIG. 4*b* shows a horizontal supply which has a tendency to result in the product being distributed in a uniform manner in the bag 2. With this type of supply, there may be a tendency to produce packagings, the cross section of which extends in a uniform manner over the height thereof.

Figure 5A:
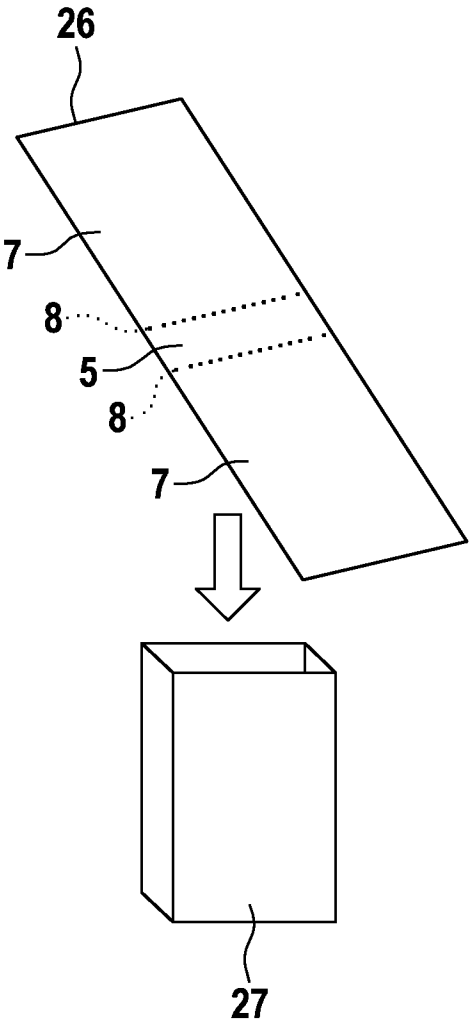
FIGS. 5*a* to 5*c*: show a sequence of a method for producing the described packaging using a folding box with an illustration of the described packaging in different method states.
Figure 5B:
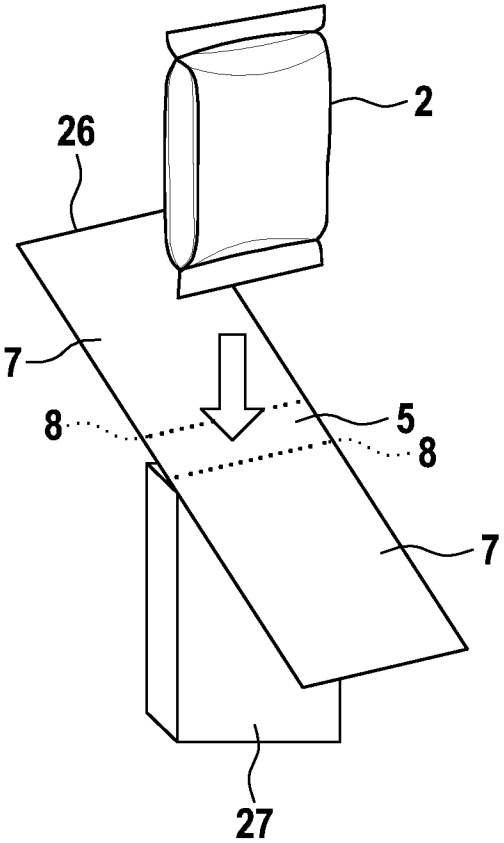
Figure 5C:
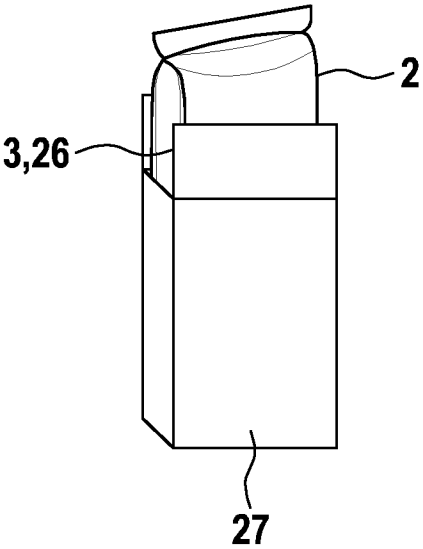

FIGS. 5*a* to 5*c* show a sequence of a specific method for producing the described packaging using a folding box 27. The folding box 27 predetermines an outer dimension of the packaging which is intended to be produced. Firstly, according to FIG. 5*a*, the cardboard blank 26 is placed with the box base face 5 on the folding box 27. Subsequently, the packaging 1 is introduced into the folding box 27. This procedure can be seen in FIG. 5*b* and FIG. 5*c*. In this instance, the cardboard blank 26 is folded at the first folding lines 8 and the box faces 7 are placed against the bag 2 in such a manner that they extend in an upward direction.

Figure 6:
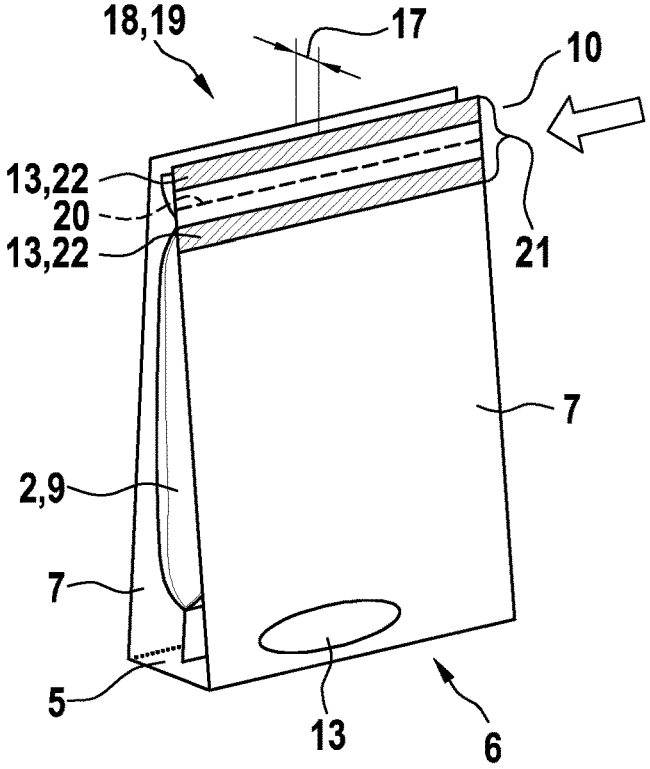
FIG. 6: shows an illustration of a variant of a described packaging.

FIG. 6 shows a variant of a described packaging 1 in which the bag 2 is connected to the box base face 5 with an adhesive connection 13. The adhesive connection 13 is schematically illustrated in this instance. It is located at an upper side of the box base face 5 and connects the bag 2 to the box base face 5 at that location. In an upper region 21, there is an access region 19 through which a product 25 contained in the bag 2 can be removed from the bag 2. The bag 2 is in the upper region 21 connected to the box faces 7 of the cardboard sleeve 3 by means of two adhesive connections 13 which are arranged one above the other and which are in the form of linear connections 22. Between the linear connections 22, there is an opening line 20 at which the bag 2 and the cardboard sleeve 3 can be separated in order to open the bag 2. A closure seam 30 (not illustrated here) of the bag 2 is preferably located above the opening line 20 at the height of the upper linear connection 20. As a result of the removal of the upper linear connection 20, a spacing 17 of the box faces 7 can be increased in order to open the access region 19 of the bag 2. In FIG. 6, by way of example, there is also marked the position 10 which is spaced apart from the standing face 6 or the cardboard base face 5 and at which the box connection webs 11 which are explained in greater detail below with reference to FIG. 7 and FIG. 8 can be arranged.

Figure 7:
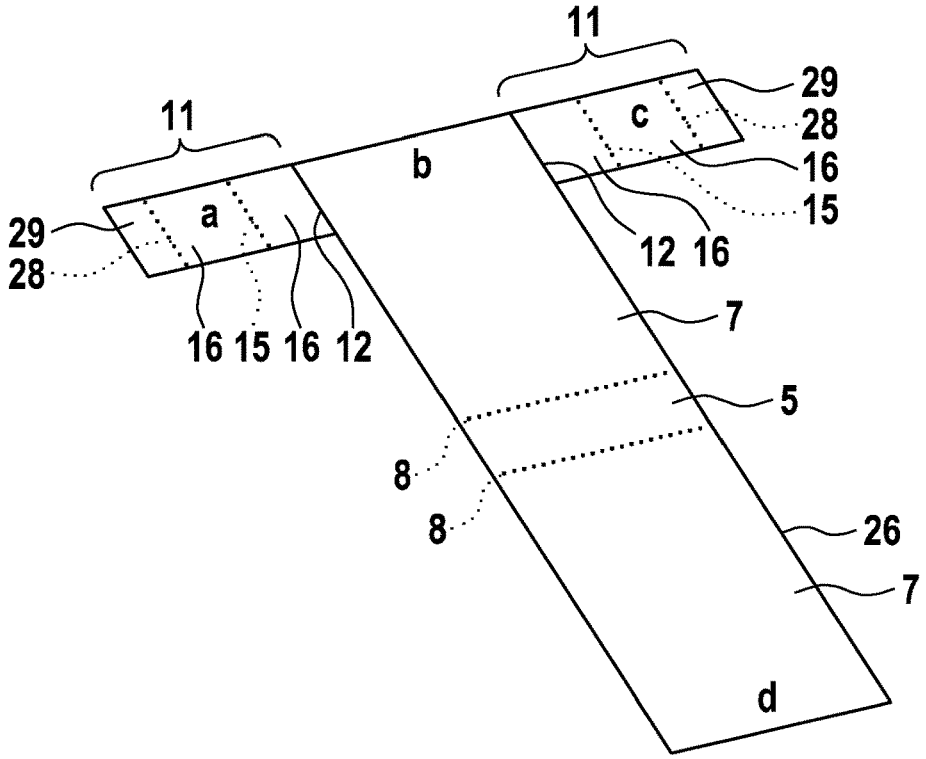
FIG. 7: shows a cardboard blank for a described packaging in an unfolded state.

FIG. 7 shows a specific cardboard blank 26 for forming a cardboard sleeve 3 for a packaging 1 described in an unfolded state. In addition, one of the box faces 7 is adjoined by box connection webs 11 which are connected to the box face 7 by means of second folding lines 12 and which are in each case configured to be adhesively bonded to an adhesive flap 29 on the other box face 7 in each case and thus to connect the two box faces 7 to each other. The adhesive flaps 29 are connected to the box connection webs 11 by means of fourth folding lines 28. Each of the box connection webs 11 is itself again subdivided into box web segments 16 so that the box connection webs 11 can be folded together at third folding lines 15 between the box web segments 16. In this manner, the upper edges of the box faces 7 and the box connection webs 11 are together configured to form a circumferential edge around an access region 19 of the packaging 1.

Figure 8:
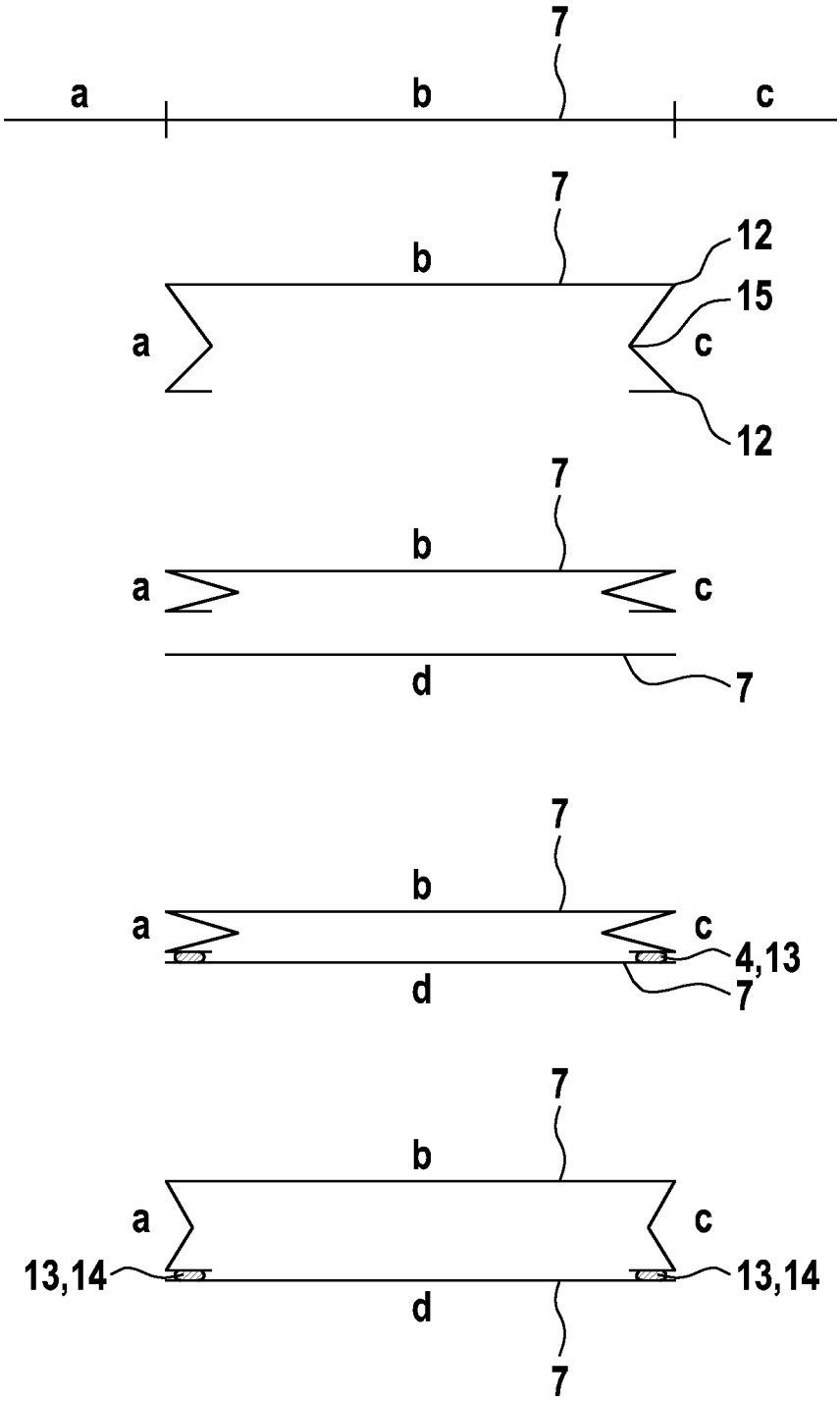
FIG. 8: shows a folding diagram for a cardboard sleeve for a described packaging.

FIG. 8 shows, with reference to five individual steps, a folding diagram according to which the cardboard blank 26 illustrated in FIG. 7 is folded in order to form the cardboard sleeve 3 with the cardboard connection webs 11. Also illustrated are connections, which are in the form of a plug type connection 14 or adhesive connection 13, of the adhesive flaps 29 of the box connection webs 11 to the respective other box faces 7.

Figure 9:
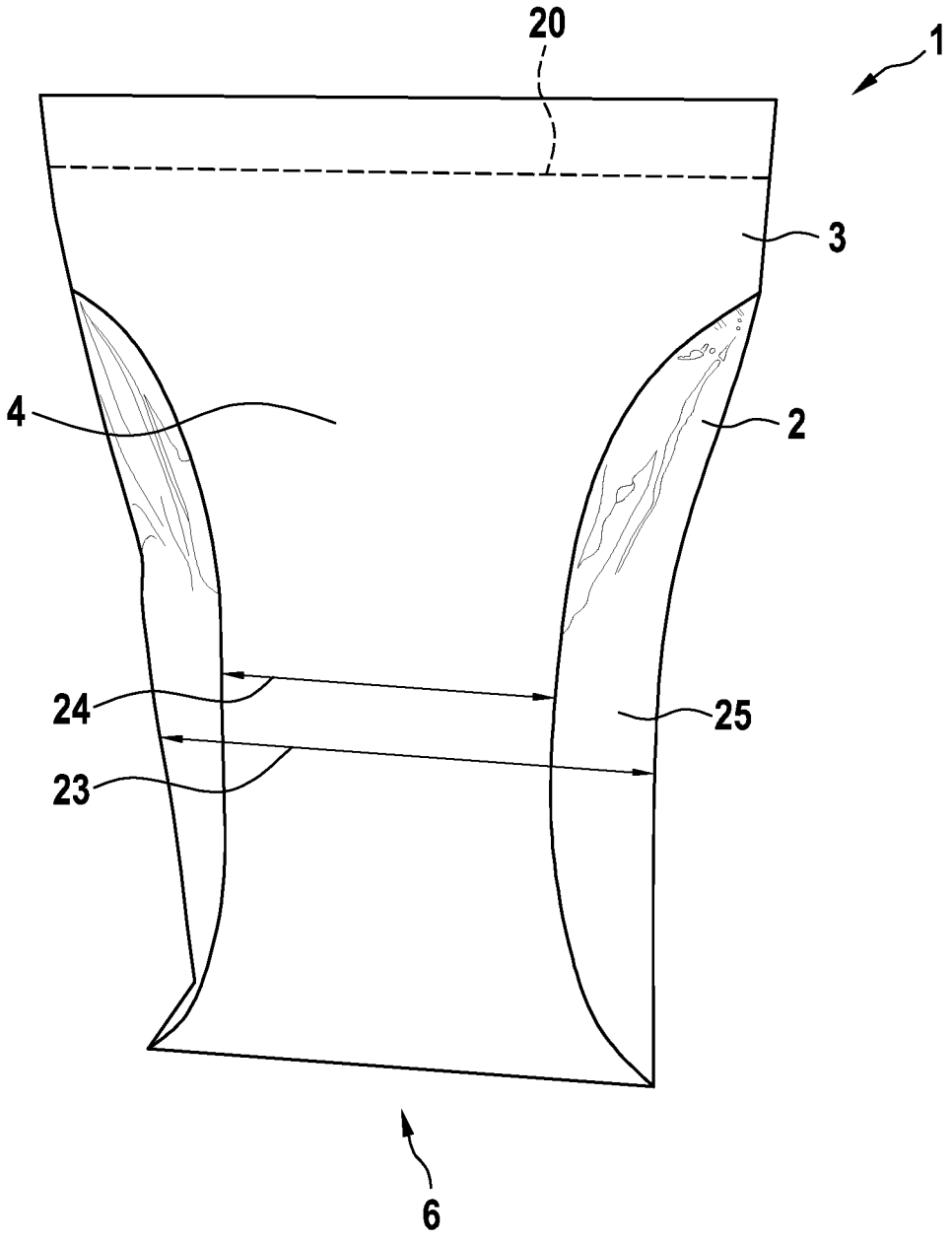
FIG. 9: shows an illustration of another variant of a described packaging.

FIG. 9 shows a variant of a described packaging 1, in which a second width 24 of the cardboard sleeve 3 is partially reduced with respect to a first width 23 of the packaging 1 and in particular of the bag 2. When the bag 2 is produced from a transparent material, as a result of this configuration, it may be possible for the product 25 in the bag 2 to be able to be seen from the side of the flattened bag face 4.

LIST OF REFERENCE NUMERALS

1 Packaging
2 Bag
3 Cardboard sleeve
4 Flattened bag face

5 Box base face
6 Standing face
7 Box face
8 First folding line
9 Exposed region
10 Spaced position
11 Box connection web
12 Second folding line
13 Adhesive connection
14 Plug type connection
15 Third folding line
16 Box web segments
17 Spacing
18 Upper side
19 Access region
20 Opening line
21 Upper region
22 Linear connection
23 First width
24 Second width
25 Product
26 Cardboard blank
27 Folding box
28 Fourth folding lines
29 Adhesive flaps
30 Closure seam

The invention claimed is:

1. A packaging (1) for a product (25) having a bag (2) for receiving the product (25) and a cardboard sleeve (3) which is arranged externally around the bag (2), wherein the bag (2) has a flattened shape with two mutually opposing flattened bag faces (4) and wherein the cardboard sleeve (3) has a box base face (5) which forms a standing face (6) of the packaging (1), and has two box faces (7) which adjoin the box base face (5) in a mutually opposing manner and extend upward from the box base face (5) and which are connected by first folding lines (8) to the box base face (5) and cover the flattened bag faces (4), wherein between the upwardly extending box faces (7) exposed regions (9) of the bag (2) are arranged, wherein the upwardly extending box faces (7) are connected to each other at a position (10) at an upper side (18) opposite from the standing face (6) of the packaging (1) with spacing from the standing face (6) at each of two sides by at least one box connection web (11), and wherein each at least one box connection web (11) is connected by second folding lines (12) to one of the upwardly extending box faces (7).

2. The packaging (1) as claimed in claim 1, wherein the bag (2) comprises a flexible bag material.

3. The packaging (1) as claimed in claim 2, wherein the flexible bag material has at least one barrier layer.

4. The packaging (1) as claimed in claim 1, wherein the bag (2) comprises a transparent material so that a product (25) contained in the bag (2) is visible at the exposed regions (9) of the bag (2).

5. The packaging (1) as claimed in claim 1, wherein the bag (2) is secured to the box base face (5) of the cardboard sleeve (3).

6. The packaging (1) as claimed in claim 1, wherein each at least one box connection web (11) is subdivided into at least two box web segments (16) which are separated from each other by third folding lines (15) so that, as a result of a deformation of each of the at least one box connection web (11) at the third folding lines (15), a change of spacing (17) of the upwardly extending box faces (7) at the upper side (18) of the packaging (1) is enabled so that an access region (19) into the packaging (1) can be expanded.

7. The packaging (1) as claimed in claim 1, wherein in an access region (19) at the upper side (18) of the packaging (1) the bag (2) has an opening line (20) at which the bag (2) can be separated in order to open the bag (2).

8. The packaging (1) as claimed in claim 1, wherein each flattened bag face (4) is connected at least in an upper region (21) opposite the standing face (6) to the upwardly extending box faces (7) by at least one linear connection (22).

9. The packaging (1) as claimed in claim 8, wherein at least one of the upwardly extending box faces (7) is connected with two linear connections (22) which are arranged one above the other to each flattened bag face (4), wherein an opening line (20) is arranged between the two linear connections (22).

10. The packaging (1) as claimed in claim 1, wherein the bag (2) has a first width (23) and wherein at least one of the upwardly extending box faces (7) has a second width (24) which is reduced compared with the first width (23) at least in regions.

11. A method for producing a packaging (1), the method having the following steps:

a) providing a bag (2) with a flattened shape with two mutually opposing flattened bag faces (4), containing a product (25);

b) supplying a cardboard blank (26) having a box base face (5) and two box faces (7) which are connected to the box base face (5) by first folding lines (8);

c) folding the cardboard blank (26) along the first folding lines (8) around the bag (2) so that a cardboard sleeve (3) is produced around the bag (2), wherein the two box faces (7) are connected to each other at a position (10) at an upper side (18) opposite from the standing face (6) of the packaging (1) with spacing from a standing face (6) at each of two sides by at least one box connection web (11), and wherein each at least one box connection web (11) is connected by second folding lines (12) to one of the two box faces (7).

12. The method as claimed in claim 11, wherein the flattened shape of the bag (2) is orientated horizontally during steps b) and c).

13. The method as claimed in claim 11, wherein the flattened shape of the bag (2) is orientated perpendicularly during steps b) and c).

14. The method as claimed in claim 11, wherein a supply of the cardboard blank (26) to the bag (2) is carried out from below.

15. The method as claimed in claim 11, wherein the folding of the cardboard blank (26) in step c) is carried out by a folding box (27) into which the cardboard blank (26) is introduced, wherein, as a result of the introduction, a folding of the cardboard blank (26) along the first folding lines (8) is supported.

* * * * *